US009890481B2

(12) United States Patent
Hamada et al.

(10) Patent No.: US 9,890,481 B2
(45) Date of Patent: Feb. 13, 2018

(54) METHOD FOR PRODUCTION OF CARBON FIBER BUNDLE

(71) Applicant: Mitsubishi Chemical Corporation, Tokyo (JP)

(72) Inventors: Mitsuhiro Hamada, Otake (JP); Hiroyuki Nakao, Otake (JP); Hiromi Aso, Otake (JP); Yoshitaka Kageyama, Otake (JP)

(73) Assignee: Mitsubishi Chemical Corporation, Tokyo (JP)

( * ) Notice: Subject to any disclaimer, the term of this patent is extended or adjusted under 35 U.S.C. 154(b) by 109 days.

(21) Appl. No.: 14/646,962

(22) PCT Filed: Nov. 22, 2013

(86) PCT No.: PCT/JP2013/081526

§ 371 (c)(1),
(2) Date: May 22, 2015

(87) PCT Pub. No.: WO2014/081015

PCT Pub. Date: May 30, 2014

(65) Prior Publication Data

US 2015/0299908 A1 Oct. 22, 2015

(30) Foreign Application Priority Data

| | | |
|---|---|---|
| Nov. 22, 2012 | (JP) | 2012-256638 |
| Jun. 3, 2013 | (JP) | 2013-116722 |
| Jun. 19, 2013 | (JP) | 2013-128123 |

(51) Int. Cl.

| | |
|---|---|
| ***C01B 31/02*** | (2006.01) |
| ***D01F 9/22*** | (2006.01) |
| ***D02J 13/00*** | (2006.01) |
| ***D06M 10/02*** | (2006.01) |
| ***D01F 9/21*** | (2006.01) |
| ***D06M 10/00*** | (2006.01) |
| ***D01D 10/00*** | (2006.01) |
| ***D01F 11/06*** | (2006.01) |
| ***D01F 6/16*** | (2006.01) |

(52) U.S. Cl.

CPC ..... *D01F 9/21* (2013.01); *D01D 10/00* (2013.01); *D01F 6/16* (2013.01); *D01F 9/225* (2013.01); *D01F 11/06* (2013.01); *D06M 10/001* (2013.01); *D06M 10/025* (2013.01)

(58) Field of Classification Search

CPC .. C01B 31/02; D01F 9/22; D01F 9/225; D02J 13/00; D06M 10/001; D06M 10/02; D06M 10/025

USPC ..... 264/29.2, 83, 448, 483; 423/447.1

See application file for complete search history.

(56) References Cited

U.S. PATENT DOCUMENTS

| | | | | |
|---|---|---|---|---|
| 6,428,892 | B2 | 8/2002 | Matsuhisa et al. | |
| 7,649,078 | B1 * | 1/2010 | Paulauskas | B29C 59/14 264/176.1 |
| 2003/0051993 | A1 | 3/2003 | Ricatto et al. | |
| 2009/0169725 | A1 * | 7/2009 | Zhamu | D01F 9/21 427/77 |
| 2009/0263295 | A1 | 10/2009 | Paulauskas et al. | |
| 2009/0277772 | A1 | 11/2009 | Kaiser et al. | |

FOREIGN PATENT DOCUMENTS

| | | | | |
|---|---|---|---|---|
| EP | 2 241 598 | A1 | 10/2010 | |
| EP | 2 441 865 | A1 | 4/2012 | |
| JP | 50 25823 | A | 3/1975 | |
| JP | 8 311723 | | 11/1996 | |
| JP | 9 143824 | | 6/1997 | |
| JP | 11 12855 | | 1/1999 | |
| JP | 2004-197279 | A | 7/2004 | |
| JP | 2006 200078 | | 8/2006 | |
| JP | 2006299439 | A * | 11/2006 | D01F 9/22 |
| KR | 10-2012-0037044 | A | 4/2012 | |
| RU | 2 343 235 | C1 | 1/2009 | |

OTHER PUBLICATIONS

Partial Supplementary European Search Report issued Oct. 16, 2015 in Patent Application No. 13856258.2.
International Search Report Issued Feb. 18, 2014 in PCT/JP2013/081526 Filed Nov. 22, 2013.
Search Report dated Feb. 22, 2016 issued in corresponding European patent application No. 13856258.2.

* cited by examiner

*Primary Examiner* — Leo B Tentoni
(74) *Attorney, Agent, or Firm* — Oblon, McClelland, Maier & Neustadt, L.L.P.

(57) ABSTRACT

The purpose of the present invention is to provide a method whereby deposits which have occurred on the surfaces of a fiber bundle during flameproofing treatment of a carbon fiber-precursor acrylic fiber bundle can be efficiently removed prior to carbonization treatment at high temperature. The method for production of carbon fiber bundle includes a step in which, after a carbon fiber-precursor acrylic fiber bundle has been heated and undergone flameproofing treatment, the fiber bundle is subjected to a plasma treatment involving contact with a plasma gas in gas phase, or to an ultraviolet treatment involving irradiation with ultraviolet in gas phase; and a step in which the fiber bundle having undergone the plasma treatment or the ultraviolet treatment is subjected to a carbonization treatment.

16 Claims, No Drawings

METHOD FOR PRODUCTION OF CARBON FIBER BUNDLE

TECHNICAL FIELD

The present invention relates to a method for producing a carbon fiber bundle, and further specifically relates to a method for producing a carbon fiber bundle by baking a carbon fiber precursor fiber bundle, wherein the method includes removing deposits on the surface of a fiber bundle that is subjected to carbonization treatment in preparing the carbon fiber bundle.

BACKGROUND ART

As a method for producing a carbon fiber bundle, known is a method of obtaining a carbon fiber bundle by performing flameproofing treatment of subjecting a carbon fiber precursor acrylic fiber bundle to heat treatment in oxidizing atmosphere of 200 to 300° C., and then performing carbonization treatment of subjecting the obtained flameproof fiber bundle to heat treatment in inactive atmosphere of 1000° C. or higher. The carbon fiber bundle obtained in this method has excellent mechanical properties, and thus is industrially broadly used particularly as a reinforcing fiber for a composite material.

In the flameproofing process of performing flameproofing treatment for a carbon fiber precursor acrylic fiber bundle in preparing a carbon fiber bundle, fusion between filaments may cause process difficulties such as fluff and bundle breakage in the flameproofing process and the carbonization process that is subsequent to the flameproofing process (hereinafter, the flameproofing process and the carbonization process may be collectively called as the "baking process".). In order to avoid this fusion, selection of oil being applied to the carbon fiber precursor acrylic fiber bundle is known to be important. Among the oils, a silicone-based oil containing silicone that is good in an effect of preventing fusion in the flameproofing process is most generally used (Patent Document 1).

In a flameproofing furnace in which flameproofing treatment is performed for a carbon fiber precursor acrylic fiber bundle, heated oxidizing gas is circulated with a fan. In this furnace, a portion of a silicone compound in silicone-based oil given to the carbon fiber precursor acrylic fiber bundle volatilizes into the oxidizing gas, and stays for a long time in the circulating gas. On the other hand, the residual portion of the silicone compound on the surface of the carbon fiber precursor acrylic fiber bundle achieves effects of preventing fusion of the filaments to each other, maintaining convergence of the carbon fiber precursor acrylic fiber bundle, and suppressing filament breakage. The silicone-based compound that volatilizes into oxidizing gas and stays for a long time in the flameproofing furnace may shortly solidify, and deposit in the furnace, and also adhere as particles to a fiber bundle in the flameproofing treatment. It is known that these particles adhering to the fiber bundle become a starting point for occurrence of fluff or occurrence of single yarn breakage in subsequent carbonization process, and remarkably lower the performances of the obtained carbon fiber. In addition, it is revealed that oil ingredients other than the silicone compound, tar ingredients derived from the carbon fiber precursor acrylic fiber bundle, dust from the outside of the furnace brought by the fiber bundle, dust contained in the air from the intake, and the like also adhere to the fiber bundle and are factors for lowering the strength of carbon fiber.

To resolve the problems described above, a technology is suggested in Patent Document 2 from a viewpoint of removing dust present in a flameproofing furnace, in which an exhaust port is arranged in an gas circulation path installed in a flameproofing furnace, and a portion of sucked gas is exhausted from the exhaust port with a circulation fan before starting operation of the flameproofing furnace, whereby to reduce and remove dust in the furnace.

On the other hand, a technology is suggested in Patent Documents 3 and 4 from a viewpoint of removing pitch and a tar-like substance and the like adhering to the surface of a fiber bundle in a process of preparing a carbon fiber bundle, wherein a flameproof fiber bundle is subjected to ultrasonic treatment in a liquid containing a surfactant, whereby to remove pitch and a tar-like substance and the like adhering to the surface of the fiber bundle, and to allow subsequent uniform carbonization, and thus to obtain a carbon fiber bundle excellent in the strength with short time flameproofing treatment.

However, the technology disclosed in Patent Document 2 needs to be performed in the state where the operation of preparing a carbon fiber bundle is stopped, and stability of a long-term continuous operation of a flameproofing furnace cannot be expected. In addition, with the technologies disclosed in Patent Document 3, it is difficult to effectively remove particles of silicon oxide derived from the silicone-based oil and the like in the inside of the fiber bundle that is an assembly of thousands to tens of thousands of filaments. In addition, the technologies disclosed in Patent Documents 3 and 4 use wet washing treatment in order to remove deposits on the surface of a fiber bundle, and inevitably need a drying treatment process of the fiber bundle, and are undesirable economically.

CITATION LIST

Patent Document

Patent Document 1: JP H11-12855 A
Patent Document 2: JP H08-311723 A
Patent Document 3: JP S50-25823 A
Patent Document 4: JP 2006-200078 A

SUMMARY OF INVENTION

Technical Problem

An object of the invention is to provide a method of effectively removing deposits on the surface of the fiber bundle which have been generated in flameproofing treatment of a carbon fiber precursor acrylic fiber bundle, before performing carbonization treatment at high temperature, whereby to produce a carbon fiber bundle having excellent properties.

Solution to Problem

The problems are resolved by Invention [1], Invention [2] or Invention [3] having the technical means below.

[1] A method for producing a carbon fiber bundle, the method comprising:

performing a plasma treatment of bringing a fiber bundle A, which is a carbon fiber precursor acrylic fiber bundle having undergone flameproofing treatment by heating, into contact with a plasma gas in gas phase; and performing carbonization treatment of a fiber bundle B, which has been obtained by the plasma treatment.

In Invention [1], it is preferred that the density of the fiber bundle A to be subjected to the plasma treatment is in a range of 1.30 g/cm$^3$ to 1.70 g/cm$^3$.

In Invention [1], it is preferred that the plasma gas is ejected from an ejection port and brought into contacted with the fiber bundle A such that a distance d between the ejection port of the plasma gas of a plasma generation device and the fiber bundle A is in a range of 0.5 mm to 10 mm.

In the plasma treatment, it is preferred that the plasma gas is generated by introducing a mixed gas of inactive gas in a range of 97.00 volume % to 99.99 volume % and active gas in a range of 0.0100 volume % to 3.000 volume % into a plasma generation device.

In the plasma treatment, it is preferred that the fiber bundle A is made into a sheet form having fineness per unit width in a range of 500 dtex/mm to 5000 dtex/mm, and the fiber bundle in the sheet form is brought into contact with plasma gas. At that time, it is preferred that the plasma gas be ejected from each direction facing to each side of the fiber bundle in the sheet form.

In Invention [1], it is preferred that the absorbance, which is measured by the measuring method below, of the fiber bundle B that is subjected to the carbonization treatment meets "Condition 1" and/or "Condition 2" below:

Condition 1: Absorbance at 240 nm of the wavelength is 1.5 or less.

Condition 2: Absorbance at 278 nm of the wavelength is 1.0 or less.

<Measuring Method>

2.0 g of a fiber bundle and 18.0 g of chloroform as an immersion liquid are put into a beaker of 100 ml volume. Next, the immersion liquid is subjected to ultrasonic treatment for 30 minutes at 100 W of the power and 40 KHz of the frequency using an ultrasonic treatment device. After the ultrasonic treatment, the fiber bundle is removed from the immersion liquid, and the obtained immersion liquid is taken as a sample liquid for measuring the absorbance. Using a spectrophotometer and a quartz cell (10 mm cell length), the sample liquid is installed on the sample side of the spectrophotometer and chloroform is installed on the reference side, and measurement for absorbance is performed at a wavelength in a range of 200 to 350 nm.

In addition, in Invention [1], the total number of cavities and particles having a size of 1 μm or more, which are present on the surface of the filaments that are present on the surface of the fiber bundle B that has undergone the plasma treatment, is desirably 5 or less per 100 μm$^2$ area of the surface of the filaments.

[2] A method for producing a carbon fiber bundle, the method comprising:

heating a fiber bundle of a carbon fiber precursor to perform flameproofing treatment; rendering the density of the fiber bundle in a range of 1.30 g/cm$^3$ to 1.70 g/cm$^3$ after the flameproofing treatment to obtain a fiber bundle C; and subjecting the fiber bundle C to carbonization treatment;

wherein the absorbance, which is measured by the measuring method below, of the fiber bundle C to be subject to the carbonization treatment meets "Condition 1" and/or "Condition 2".

[3] A method for producing a carbon fiber bundle, the method comprising:

heating a fiber bundle of a carbon fiber precursor to perform flameproofing treatment; rendering the density of the fiber bundle in a range of 1.30 g/cm$^3$ to 1.70 g/cm$^3$ after the flameproofing treatment to obtain a fiber bundle C; and subjecting the fiber bundle C to carbonization treatment;

wherein the total number of cavities and particles having a size of 1 μm or more, which are present on the surface of the filaments that are present on the surface of the fiber bundle C to be subjected to the carbonization treatment is 5 or less per 100 μm$^2$ area of the surface of the filaments.

In Invention [2] or Invention [3], the fiber bundle C to be subjected to the carbonization treatment is preferably a fiber bundle that is obtained by performing plasma treatment of bringing the fiber bundle into contact with a plasma gas in gas phase, or ultraviolet ray treatment of irradiating the fiber bundle with a ultraviolet ray in gas phase, after the flameproofing treatment. In addition, the ultraviolet ray treatment is preferably performed in the presence of oxygen.

Advantageous Effects of Invention

According to the present invention, it is possible to effectively remove deposits, which adhere to the surface of the fiber, generated in a flameproofing treatment of a carbon fiber precursor acrylic fiber bundle (hereinafter, may called as a "precursor fiber bundle".), derived from the precursor fiber bundle or derived from silicone oil that is applied to the precursor fiber bundle, before performing carbonization treatment at high temperature, and prevent fusion of the filaments of the fiber bundle to each other during producing of the carbon fiber bundle whereby to produce a carbon fiber bundle that is improved in carbon fiber strand tensile strength.

DESCRIPTION OF EMBODIMENTS

The present invention will be described in detail below.

As a mechanism for a decrease in the strength of a carbon fiber, it is considered that deposits that has adhered to the surface of the fiber in a flameproofing furnace, derived from a precursor fiber bundle or derived from silicone oil that is applied to the precursor fiber bundle, react with the carbon fiber under high temperature in subsequent carbonization process, causing the carbon fiber to be oxidized to carbon monoxide and the like and vaporized. The temperature at which this reaction occurs is considered to vary depending on the ingredients of the deposits, but is generally considered to be 500° C. or higher.

The inventors found that it is effective to perform a plasma treatment in gas phase, or perform an ultraviolet ray treatment in gas phase, with respect to a fiber bundle which has undergone flameproofing treatment of a precursor fiber bundle, as a method of removing the deposits from the surface of the fiber bundle which has undergone the flameproofing treatment of the precursor fiber bundle before the deposits react with the carbon fiber. By subjecting the fiber bundle, which has undergone the plasma treatment or the ultraviolet ray treatment, to carbonization treatment, it becomes possible to stably produce a carbon fiber bundle that is excellent in performances.

The fiber bundle B or the fiber bundle C, which is subjected to the carbonization treatment in Invention [1], Invention [2], or Invention [3], is a fiber bundle that has undergone flameproofing treatment, or a fiber bundle that has undergone flameproofing treatment and pre-carbonization treatment. The precursor acrylic fiber bundle can be made into a fiber bundle having a density in a range of 1.30 g/cm$^3$ to 1.50 g/cm$^3$ by the flameproofing treatment. In addition, the precursor acrylic fiber bundle can be made into a fiber bundle having a density in a range of 1.50 g/cm$^3$ to 1.70 g/cm$^3$ by the flameproofing treatment and the pre-carbonization treatment.

<Carbon Fiber Precursor Acrylic Fiber Bundle>

First, the precursor fiber bundle used in the present invention will be described. The precursor fiber bundle can be prepared by a well-known spinning method by dissolving an acrylonitrile-based polymer in an organic solvent or inorganic solvent and supplying the obtained spinning dope to a spinning device. A spinning method and spinning conditions are not particularly limited.

Herein, the acrylonitrile-based polymer is not particularly limited, but a homopolymer or copolymer containing 85 mole % or more and more preferably 90 mole % or more of acrylonitrile units can be used. Alternatively, a mixed polymer of two or more kinds of these polymers can be used. The acrylonitrile copolymer is a copolymerization product of acrylonitrile with a monomer that can be copolymerized with acrylonitrile. Examples of the monomer that can be copolymerized with acrylonitrile include, for example, the followings: (meth)acrylic acid esters such as methyl(meth)acrylate, ethyl(meth)acrylate, propyl(meth)acrylate, butyl(meth)acrylate and hexyl(meth)acrylate; vinyl halides such as vinyl chloride, vinyl bromide and vinylidene chloride; acids such as (meth)acrylic acid, itaconic acid and crotonic acid, and salts thereof; maleic imide, phenyl maleimide, (meth)acrylic amide, styrene, α-methyl styrene and vinyl acetate; polymerizable unsaturated monomers containing a sulfonic group such as sodium styrene sulfonate, sodium ally sulfonate, sodium β-styrene sulfonate and sodium methallyl sulfonate; polymerizable unsaturated monomers containing a pyridine group such as 2-vinyl pyridine and 2-methyl-5-vinyl pyridine; and the like.

As the polymerization method, solution polymerization, suspension polymerization, emulsification polymerization and the like, which are conventionally known, may be applied. Examples of the solvent used in preparation of the acrylic-based polymer solution include dimethyl sulfoxide, dimethyl acetamide, dimethyl formamide, an aqueous solution of zinc chloride, nitric acid and the like.

As the spinning method, a wet spinning method, a dry wet spinning method, a dry spinning method and the like may be adopted. The obtained coagulated yarn is made to a precursor fiber bundle having predetermined fineness by performing water washing, drawing in a bath, drying refinement, steam drawing, granting process oil such as silicone-based oil and the like, which are conventionally known.

A method of applying silicone-based oil to the precursor fiber bundle is not particularly limited, but examples thereof include a method of immersing the precursor fiber bundle in a water dispersion of silicone-based oil, which method is generally used.

Herein, the silicone-based oil is oil containing an organic compound containing silicon atoms (silicone compound) as a main ingredient. The silicone-based oil may be a mixture with another organic compound than the silicone compound. In addition, the silicone-based oil may be a mixture that is constituted by adding a surfactant or a smoothing agent, an antistatic agent, an antioxidant and the like to the silicone compound. Representative examples of the silicone-based oil may include amino-modified silicone-based oil, which is conventionally known.

Meanwhile, as the oil, non-silicone-based oil can be used in addition to the silicone-based oil. The non-silicone-based oil is oil containing an organic compound not containing a silicon atom (non-silicone compound) as a main ingredient. Representative examples of the non-silicone-based oil may include oil containing an aromatic compound as a main ingredient (for example, an aromatic polyester, an aromatic amine compound, and a trimellitic acid ester), oil containing an aliphatic compound as a main ingredient (for example, a polyolefin polymer, an ethylene diamide-based compound, and a higher alcohol phosphoric acid ester salt), and the like.

<Flameproofing Treatment>

The fiber bundle A that is subjected to plasma treatment, and has a density in a range of 1.30 g/cm$^3$ to 1.50 g/cm$^3$ can be obtained by heating the precursor fiber bundle under tension or under drawing condition from 200° C. to 300° C. in oxidizing atmosphere to perform flameproofing treatment. The oxidizing atmosphere is not particularly limited if it is a gas containing oxygen, but air is particularly excellent in consideration of economy and safety. In addition, oxygen concentration in the oxidizing atmosphere can be also changed in order to adjust oxidation ability. Examples of the method of heating a fiber bundle in the flameproofing process and a heating mode including the structure of a flameproofing furnace may include general hot wind circulation mode, fixed hot plate mode having a perforated panel surface described in JP 7-54218 A, and the like. However, other modes besides them may be also applied.

By setting the fiber density to 1.30 g/cm$^3$ or more, flameproofing reaction sufficiently proceeds, fusion of the filaments to each other is suppressed in heat treatment at high temperature such as pre-carbonization treatment and carbonization treatment in inactive gas atmosphere that is subsequently performed, and a carbon fiber bundle can be stably produced. By setting the fiber density to 1.50 g/cm$^3$ or less, introduction of oxygen to the inside of the fiber bundle is moderately kept, the internal structure of the finally obtained carbon fiber can be made compact, and a carbon fiber bundle having excellent performances can be obtained. The fiber density is more preferably 1.45 g/cm$^3$ or less from an economic aspect.

<Pre-Carbonization Treatment>

On the other hand, a fiber bundle A, which is a fiber bundle that is subjected to a plasma treatment and has a density in a range of 1.50 g/cm$^3$ to 1.70 g/cm$^3$, can be obtained by heating the flameproof fiber bundle described above in inactive atmosphere of 300° C. to 1000° C. or less (pre-carbonization treatment). The condition for the pre-carbonization treatment is preferably treatment under tension in inactive atmosphere at maximum temperature of 550 to 1000° C. At that time, in a temperature region of 300 to 500° C., the flameproof fiber bundle is heated at a temperature elevation rate of 500° C./minute or less and preferably 300° C./minute or less, which is effective in order to improve the mechanical properties of the finally obtained carbon fiber bundle. As the atmosphere, known inactive atmosphere such as nitrogen, argon, helium and the like may be adopted, but nitrogen is desirable from an economic aspect. The density after the pre-carbonization treatment is preferably 1.50 g/cm$^3$ or more from a viewpoint that flameproofing reaction does not proceed at the time of contact with plasma gas. In addition, the fiber density after the pre-carbonization treatment is preferably 1.70 g/cm$^3$ or less from a viewpoint of the economy.

<Plasma Treatment>

In Invention [1], the fiber bundle A that has undergone the flameproofing treatment is subjected to a plasma treatment of bringing the fiber bundle into contact with a plasma gas in gas phase.

Herein, the plasma treatment will be described. Plasma gas has the state that gas molecules are partially or completely ionized, or divided into a positive ion and electron, and move, and thus is very high active. For that reason, by bringing an object to be treated into contact with plasma gas, it is possible to modify the surface of the object to be treated whereby to give various functions to the object to be treated.

The plasma treatment is broadly divided into atmospheric pressure plasma treatment and low pressure or vacuum plasma treatment, and the plasma treatment is desirably atmospheric pressure plasma treatment that does not need decompression treatment in the process, from a viewpoint of continuous production and economy. Methods for the plasma treatment of the fiber bundle are broadly divided into direct methods and remote methods, and are not particularly limited. The direct method is a method in which the fiber bundle is placed and treated between two sheets of plate electrodes that are placed parallel to one another. The direct method generally has high the treatment efficiency since the fiber bundle is directly introduced to plasma atmosphere, and allows accurate control of the treatment condition whereby to arbitrarily control chemical modification (for example, introduction of a functional group to the surface of the object to be treated) and physical modification (for example, roughening of the surface of the object to be treated). The remote method is a method in which plasma generated between electrodes is blow to the fiber bundle and treated. In consideration of heat and electrical damage to the fiber bundle, the remote method is preferably selected, which causes less damage.

In an atmospheric pressure plasma generation device for performing the plasma treatment, the distance d between the ejection port of the plasma gas of the generation device and the fiber bundle A is preferably 10 mm or less from a viewpoint of effectively bringing the plasma gas into contact with the fiber bundle. In addition, this distance is preferably 5.0 mm or less, and more preferably 3.0 mm or less from a viewpoint of the treatment efficiency. In addition, the distance d is preferably 0.5 mm or more, and more preferably 1.0 mm or more in order to avoid contact of the ejection port of the plasma gas and the fiber bundle.

In performing the plasma treatment with respect to the fiber bundle A that has undergone the flameproofing treatment, introduction gas that is introduced to a plasma treatment room of the plasma generation device is not particularly limited. However, inactive gas is excellent from a viewpoint of safety, and further a gas containing nitrogen, argon, or nitrogen and argon as a main ingredient is excellent from a viewpoint of availability and economy.

In addition, it is preferred that a small amount of active gas be added to the inactive gas and a mixed gas is used from a viewpoint of ability for removing the deposits. Examples of specific active gas include air, oxygen, hydrogen, carbon monoxide, and other non-dangerous gas. The composition ratio by volume in this mixed gas is preferably inactive gas in a range of 97.00 volume % to 99.99 volume % and active gas in a range of 0.0100 volume % to 3.000 volume %. From a viewpoint of ability for removing the deposits and stability of plasma generation, this composition ratio by volume is more preferably inactive gas in a range of 99.00 volume % to 99.99 volume %, and active gas in a range of 0.0100 volume % to 1.000 volume %.

The gas preferably contains oxygen as the active gas. By performing the plasma treatment in the presence of oxygen, it becomes possible to further effectively remove the deposits on the surface of the fiber bundle. This is considered to be caused that ozone is generated from reaction of plasma gas with oxygen, and this ozone synergistically works with excitation light that is generated in plasma formation in a gas phase, whereby to effectively remove deposits on the surface of the fiber.

When the fiber bundle A is brought into contact with plasma gas, it is preferred that the fiber bundle be made into a sheet form having a fineness per unit width of the fiber bundle in a range of 500 dtex/mm to 5000 dtex/mm. If the fineness is 500 dtex/mm or more, this is preferred because multiple fiber bundles can be produced at one time although the width of the fiber bundle is broad. In addition, if the fineness is 5000 dtex/mm or less, deposits that have adhered to the fiber bundle are removed effectively and easily. From the viewpoints described above, the fineness is more preferably 4000 dtex/mm or less, and further preferably 3000 dtex/mm or less.

In order to perform uniform plasma treatment to the fiber bundle A, one or more pieces of atmospheric pressure plasma generation devices are desirably used. The plasma treatment is preferably performed from multiple directions with respect to the fiber bundle A, but from a viewpoint of economy, the plasma treatment is preferably performed from each direction facing to each side of the fiber bundle in the sheet form. Namely, it is preferred that plasma gas be contacted from one side direction of the fiber bundle, and further simultaneously and subsequently, the fiber bundle is brought into contact with plasma gas from the opposite direction of the fiber bundle.

The total fineness of the fiber bundle A that is subjected to plasma treatment is preferably 3,000 dtex or more from a viewpoint of production, and preferably 100,000 dtex or less from a viewpoint of performing uniform treatment. The total fineness is preferably in a range of 5,000 to 70,000 dtex for further improved production and implement of further uniform treatment.

It is preferred that the fiber bundle B that is a fiber bundle which have undergone the plasma treatment and is to be subjected to the carbonization treatment has an absorbance that meets "Condition 1" and/or "Condition 2" below, wherein the absorbance is measured by the measuring method below. If the absorbance is in a range of "Condition 1" and/or "Condition 2", it is possible to obtain a high quality carbon fiber bundle by carbonization of the fiber bundle B.

Condition 1: Absorbance at 240 nm of the wavelength is 1.5 or less.

Condition 2: Absorbance at 278 nm of the wavelength is 1.0 or less.

<Measuring Method>

2.0 g of a fiber bundle and 18.0 g of chloroform as an immersion liquid are put into a beaker of 100 ml volume. Next, the immersion liquid is subjected to ultrasonic treatment for 30 minutes at 100 W of the power and 40 KHz of the frequency using an ultrasonic treatment device. After the ultrasonic treatment, the fiber bundle is removed from the immersion liquid, and the obtained immersion liquid is taken as a sample liquid for measuring the absorbance. Using a spectrophotometer and a quartz cell (10 mm cell length), the sample liquid is installed on the sample side of the spectrophotometer and chloroform is installed on the reference side, and measurement for absorbance is performed at a wavelength in a range of 200 to 350 nm.

In the measurement of the absorbance, the absorbance in the vicinity of 240 nm of the wavelength represents an absorption peak of the deposit derived from a silicone compound, and the absorbance in the vicinity of 278 nm of the wavelength represents an absorption peak of the deposit derived from the precursor fiber bundle.

In the case where the density of the fiber bundle A that is to be subjected to the plasma treatment is in a range of 1.30 $g/cm^3$ to 1.50 $g/cm^3$, the absorbance at 240 nm of the wavelength is preferably 1.5 or less. If this absorbance is 1.5 or less, the deposits on the surface of the fiber are sufficiently removed, and fusion between filaments in the fiber bundle during the carbonization treatment that is subsequently performed is suppressed, and further the obtained carbon fiber bundle has excellent strength. This absorbance is further preferably 1.0 or less. The lower limit of this absorbance is not particularly limited, but the smaller is the more preferable. In addition, the absorbance at 278 nm of the wavelength is preferably 1.0 or less. If this absorbance is 1.0 or less, the deposits on the surface of the fiber are sufficiently removed, fusion between the filaments of the fiber bundle in the subsequent carbonization treatment is suppressed, and the carbon fiber bundle has excellent strength. This absorbance is further preferably 0.50 or less. Meanwhile, the lower limit of this absorbance is not particularly limited, but the smaller is the more preferable.

In addition, in the case where the density of the fiber bundle A that is to be subjected to the plasma treatment is in a range of 1.50 g/cm$^3$ to 1.70 g/cm$^3$, the absorbance at 240 nm of the wavelength is preferably 0.20 or less. If this absorbance is 0.20 or less, the deposits on the surface of the fiber are sufficiently removed, fusion between the filaments of the fiber bundle in the subsequent carbonization treatment is suppressed, and the carbon fiber bundle has excellent strength. This absorbance is further preferably 0.10 or less. The lower limit of this absorbance is not particularly limited, but the smaller is the more preferable. In addition, the absorbance at 278 nm of the wavelength is preferably 1.0 or less. If this absorbance is 0.15 or less, the deposits on the surface of the fiber are sufficiently removed, fusion between the filaments of the fiber bundle in the subsequent carbonization treatment is suppressed, and the carbon fiber bundle has excellent strength. This absorbance is further preferably 0.10 or less. The lower limit of this absorbance is not particularly limited, but the smaller is the more preferable.

On the surface of the fiber bundle that has undergone the flameproofing treatment, there are tar-like deposits in whose form heat decomposition products derived from a precursor fiber or oil adhere to the fiber bundle, deposits composed of low crystalline carbonized materials (hereinafter, shortly called as a "particle"), or weak parts having a heterogeneous structure that occurs from thermal injury or mechanical injury of the fiber bundle (hereinafter, shortly called as a "cavity"). These weak parts generally have relatively low crystallinity, and are composed of carbon materials having irregular structure. These portions of the particles and cavities on the surface of the fiber remain as particular deposits and cavities on the surface of the finally obtained carbon fiber. These deposits and the cavities weaken the bond between the carbon fiber and a matrix resin, and produce an aperture in the interface between the carbon fiber and the matrix resin. If load is applied to a composite product composed of such carbon fiber and the matrix resin, stress concentration is caused at the portion of the weak bond and the aperture, which easily become a starting point of the fracture. Namely, the particles and the cavities present on the surface of the fiber bundle that has undergone the flameproofing treatment become a cause for lower quality of a composite product.

With respect to the pre-carbonized fiber bundle that has undergone the plasma treatment, the total number of the cavities and particles having a size of 1 μm or more which are present on the surface of the filaments present on the surface of the fiber bundle is preferably 5 or less, and more preferably 3 or less per 100 μm$^2$ (=10 μM×10 μm) of the area of the surface of the filaments. If the total number of the cavities and particles is 5 or less, it is possible to suppress fusion between the filaments of the fiber bundle in the carbonization treatment, and thus lowering of the strength of the carbon fiber bundle is suppressed. The cavity or particle having a size of 1 μm or more means a cavity or particle of which the shortest diameter is 1 μm or more. The upper limit of the size of the cavity or particle is not particularly limited, but generally is 5 μm. The number of the cavity or particle can be measured by observing the surface of the fiber from the direction perpendicular to the fiber-axis direction of the filament using an electron microscope. The number of the cavity or particle can be indicated with the mean value of the number measured at 3 spots which are arbitrary measurement spots on the surface of the fiber.

<Invention [2] and Invention [3]>

Invention [2] is a method for producing a carbon fiber bundle, which includes: heating a fiber bundle of a carbon fiber precursor to perform a flame proofing treatment; rendering the density of the fiber bundle in a range of 1.30 g/cm$^3$ to 1.70 g/cm$^3$ after the flameproofing treatment to obtain a fiber bundle C; and subjecting the fiber bundle C to carbonization treatment;

wherein the method is characterized that with respect to the fiber bundle C that is subjected to carbonization treatment, the absorbance, which is measured by the measuring method below, meets "Condition 1" and/or "Condition 2" below.

Condition 1: Absorbance at 240 nm of the wavelength is 1.5 or less.

Condition 2: Absorbance at 278 nm of the wavelength is 1.0 or less.

<Measuring Method>

2.0 g of a fiber bundle and 18.0 g of chloroform as an immersion liquid are put into a beaker of 100 ml volume. Next, the immersion liquid is subjected to ultrasonic treatment for 30 minutes at 100 W of the power and 40 KHz of the frequency using an ultrasonic treatment device. After the ultrasonic treatment, the fiber bundle is removed from the immersion liquid, and the obtained immersion liquid is taken as a sample liquid for measuring the absorbance. Using a spectrophotometer and a quartz cell (10 mm cell length), the sample liquid is installed on the sample side of the spectrophotometer and chloroform is installed on the reference side, and measurement for absorbance is performed at a wavelength in a range of 200 to 350 nm.

Invention [3] is a method for producing a carbon fiber bundle, which includes: heating a fiber bundle of a carbon fiber precursor to perform a flame proofing treatment; rendering the density of the fiber bundle in a range of 1.30 g/cm$^3$ to 1.70 g/cm$^3$ after the flameproofing treatment to obtain a fiber bundle C; and subjecting the fiber bundle C to carbonization treatment;

wherein the method is characterized that the total number of cavities or particles having a size of 1 μm or more, which are present on the surface of the filaments that are present on the surface of the fiber bundle C to be subjected to the carbonization treatment, is 5 or less per 100 μm$^2$ area of the surface of the filaments.

In Invention [2] or Invention [3], the flameproofing treatment and the pre-carbonization treatment can be performed similarly to Invention [1].

<Ultraviolet Ray Treatment>

As a method of removing deposits on the surface of a fiber bundle that is subjected to carbonization treatment, a plasma treatment has been described above. However, an ultraviolet ray treatment may be adopted instead of the plasma treatment. Namely, the fiber bundle that is subjected to carbonization treatment can be obtained by performing a plasma treatment of bringing the fiber bundle into contact with a plasma gas in gas phase, or by performing an ultraviolet ray treatment of irradiating the fiber bundle with ultraviolet ray in gas phase.

Ultraviolet ray in the ultraviolet ray treatment is an electromagnetic wave of invisible ray having a wavelength in a range of 10 to 400 nm, and the energy thereof is sufficient to effectively decompose and remove the deposits on the surface of the fiber bundle. For that reason, by irradiating the surface of the flameproof fiber bundle with ultraviolet ray, it becomes possible to remove the deposits on the surface of the fiber. By performing the ultraviolet ray treatment in the presence of oxygen, it is possible to effectively remove the deposits on the surface of the fiber.

Ultraviolet ray is further broadly divided into extreme ultraviolet ray having a wavelength in the range of 1 to 10 nm, far ultraviolet ray having a wavelength in the range of 10 to 200 nm, and near ultraviolet ray having a wavelength in the range of 200 to 380 nm. Although the ultraviolet ray is not particularly limited, ultraviolet ray in far ultraviolet ray region or near ultraviolet ray region is preferably used from a viewpoint of suppressing injury of the flameproof fiber bundle.

Luminous energy per unit area of ultraviolet ray used in the ultraviolet ray treatment is preferably in a range of 3 $mW/cm^2$ to 10 $mW/cm^2$. If the luminous energy is 3 $mW/cm^2$ or more, the effect of removing the deposits by the ultraviolet ray treatment is obtained. If the luminous energy is 10 $mW/cm^2$ or less, there is no fear of process difficulty (generation of fluff).

In the ultraviolet ray treatment, by setting the density of the fiber bundle to be subjected to ultraviolet ray treatment to a range of 1.30 $g/cm^3$ to 1.50 $g/cm^3$, it is possible to effectively remove the deposits on the surface of the fiber.

The fiber bundle having a density in a range of 1.30 $g/cm^3$ to 1.50 $g/cm^3$ can be obtained by heating a precursor fiber bundle under tension or drawing condition in oxidizing atmosphere in a range of 200° C. to 300° C. to perform the flameproofing treatment. The fiber bundle having a density of 1.30 $g/cm^3$ or more is a fiber bundle in which flameproofing has sufficiently proceeded, and thus fusion between the filaments in heat treatment at high temperature such as pre-carbonization treatment and carbonization treatment that is subsequently performed under inactive gas atmosphere, is suppressed, and a carbon fiber bundle can be stably produced. The fiber bundle having a density of 1.50 $g/cm^3$ or less is a fiber bundle in which introduction of oxygen into the inside of the fiber bundle is moderately kept, and thus the internal structure of the finally obtained carbon fiber can be made compact, and a carbon fiber bundle having excellent performances can be obtained. From an economic aspect, the density is more preferably 1.45 $g/cm^3$ or less.

<Carbonization Treatment>

The fiber bundle which has undergone the plasma treatment obtained by the method described above, or the fiber bundle which has undergone the ultraviolet ray treatment, can be subjected to carbonization treatment whereby to obtain a carbon fiber bundle.

With respect to the conditions of the carbonization treatment, the carbonization treatment is performed in inactive atmosphere in a range of more than 1000° C. and up to 3000° C., and heating from a temperature region in a range of more than 1000° C. and up to 1200° C. to the maximum temperature ranging from 1200 to 3000° C. at 500° C./minute or less, preferably 300° C./minute or less of the temperature elevation rate is effective to improve mechanical properties of the carbon fiber. With respect to the atmosphere, known inactive atmosphere such as nitrogen, argon and helium, and the like can be adopted, but nitrogen is desirable from an economic aspect.

Thus obtained carbon fiber bundle may be made into a graphitized fiber bundle by further heating the carbon fiber bundle to a temperature region in a range of 2500 to 3000° C. of the maximum temperature.

It is preferred that thus obtained carbon fiber bundle or graphitized fiber bundle be subjected to electrolytic oxidation treatment in a conventionally known electrolytic solution, or oxidation treatment in a gas phase or in a liquid phase, whereby to modify the state of the surface thereof, and thus improve affinity and adhesiveness between the carbon fiber or graphitized fiber and a matrix resin in a composite material. Further, the carbon fiber bundle or graphitized fiber bundle may be treated with a sizing agent by a conventionally known method as necessary.

EXAMPLES

The present invention will be described further specifically with Examples below. Meanwhile, the evaluation methods are as described below.

[1. Absorbance]

The absorbance is measured using the devices and the solvent below according to the method described above.

Ultrasonic washing device: VS-200 (product name) manufactured by IUCHI.

Spectrophotometer: U-3300 (product name) manufactured by HITACHI, Ltd.

Chloroform: 99.8% Chloroform for spectroscopic analysis (manufactured by Wako Pure Chemical Industries, Ltd.).

In measurement of the absorbance, measurement of reference using chloroform is first performed, and transmittance at a predetermined wavelength (240 nm or 278 nm) is taken as $T_0$. Subsequently, using a sample liquid, measurement is performed in a similar method, and the obtained transmittance is taken as T. Absorbance A calculated by the equation described below is taken as an index representing the adherence amount of the deposits on the surface of the fiber.

$$\text{Absorbance } A = -\log_{10}(T/T_0)$$

Herein, the absorbance in the vicinity of 240 nm represents a silicone compound-derived peak, and the absorbance in the vicinity of 278 nm represents a precursor fiber bundle-derived peak.

[2. Properties of Resin-Impregnated Strand]

The strength of the strand and the elastic modulus of the strand are measured in accordance with the test method described in JIS R7608.

[3. Number of Deposits Per 100 $\mu m^2$ of the Fiber Surface of Pre-Carbonized Fiber Bundle]

The pre-carbonized fiber bundle that has undergone the plasma treatment is put on a sample stand, and the surface of the filaments is observed with a scanning electron microscope (JSM-5300, manufactured by JEOL Ltd.) at 15 kV of the acceleration voltage and at the magnification of ×5000. From the photographed images, arbitrary 3 spots on the filaments are selected, and the total number of cavities and particles having a size of 1 μm or more contained in 100 $\mu m^2$ (=10 μm×10 μm) area at each spot is counted. The mean value of the counts at the 3 spots is calculated, and indicated as the "amount of a foreign substance".

[4. Dispersion Test for Flameproof Fiber Bundle or Pre-Carbonized Fiber Bundle]

The fiber bundle is cut to obtain a sample 3 mm in length. A beaker of 100 ml volume is charged with 50 ml chloroform and the sample, and stirred for 10 minutes with a stirrer, to disperse the fiber bundle in chloroform. Then, the number of adhesions between filaments (the number of fiber assemblies) per 12000 (12K) filament is measured, and the number is taken as the result of the dispersion test.

Example 1

Using a copolymer composed of 96 mole % acrylonitrile unit, 3 mole % acrylic amide unit, and 1 mole % methacrylic acid unit, 20 mass % concentration of a solution of the copolymer in dimethyl acetamide (DMAc) was prepared. This solution (spinning dope) was ejected into 67 mass % concentration of an aqueous solution of DMAc at 35° C. temperature through a spinning mouthpiece of 12000 hole number and 60 μm pore size, and coagulated to give a coagulated fiber bundle. Then, the coagulated fiber bundle was drawn to 5.4 folds while removing the solvent in a washing tank to give a precursor fiber bundle in a swollen state. Then, this precursor fiber bundle in the swollen state was immersed in oil treatment bath filled up with a treatment liquid having amino-modified silicone oil, to provide the surface of the fiber bundle with the treatment liquid. Then, the precursor fiber bundle provided with the treatment liquid was brought into contact with a heat roll set to 180° C. of the surface temperature, and dried, and then drawn to 1.4 folds using a roll set to 190° C. of the surface temperature, to give a precursor fiber bundle having 0.8 dtex of the filament fineness and 9600 dtex of the total fineness.

The obtained precursor fiber bundle was heated under tension at 230 to 270° C. in air, to give a flameproof fiber bundle having 1.35 g/cm$^3$ of the density. This flameproof fiber bundle was subjected to plasma treatment at the conditions described below. Argon as an introduction gas was introduced at a flow rate of 15 L/min into a plasma treatment room of an atmospheric pressure plasma device (MyPL Auto 100 manufactured by WELL Corporation), and the plasma gas was brought into contact with the fiber bundle for 1 second at the conditions of 1.0 mm of the distance d between the ejection port of the plasma gas and the fiber bundle, and 100 W of the power of the atmospheric pressure plasma device, to give a flameproof fiber bundle that has undergone the plasma treatment.

Then the flameproof fiber bundle that has undergone the plasma treatment was heated under tension at 700° C. of the maximum temperature in nitrogen atmosphere to give a pre-carbonized fiber bundle. Then, the pre-carbonized fiber bundle was further heated at 1300° C. of the maximum temperature in nitrogen atmosphere under tension to give a carbonized fiber bundle.

The obtained carbonized fiber bundle was surface-treated, and then provided with a sizing agent to give a carbon fiber bundle having 4500 dtex of the total fineness. Properties of a resin-impregnated strand of this carbon fiber bundle were measured, and the elastic modulus was 326 GPa, and the strength was 5.6 GPa.

On the other hand, 2.0 g of the flameproof fiber bundle that has undergone the plasma treatment was gathered, and was supplied to absorbance measurement. The absorbances at 240 nm and 278 nm of the wavelength were 1.2 and 0.87, respectively.

Comparative Example 1

With respect to a flameproof fiber bundle obtained in the same way as that of Example 1, the absorbance was measured at 240 nm and 278 nm of the wavelength by the same method to that of Example 1 without performing the plasma treatment. The absorbances were 2.3 and 1.6, respectively. Further, the flameproof fiber bundle was processed in the same way as Example 1, to give a carbon fiber bundle. Properties of a resin-impregnated strand of this carbon fiber bundle were 324 GPa of the elastic modulus and 5.3 GPa of the strength.

Example 2

A flameproof fiber bundle obtained in the same way as that of Example 1 was made into a sheet form of the fiber bundle having 1920 dtex/mm of the fineness per unit width. Nitrogen as introduction gas was used, and introduced at 75 L/min into a plasma treatment room of an atmospheric pressure plasma device AP-T03-S230 (SEKISUI CHEMICAL CO., LTD.). The ejection port of the plasma gas of the plasma device was placed such that plasma gas was blowed to the fiber bundle in the vertical direction of the sheet side of the sheet form of the fiber bundle, and at this state, the fiber bundle was subjected to plasma treatment for 0.5 seconds at 375 W of the power. Then, the fiber bundle that had undergone the plasma treatment was processed in the same way as Example 1, to give a carbon fiber bundle. The measurement results obtained in the same method to that of Example 1 are described in Table 1.

Example 3

Plasma treatment of the flameproof fiber bundle was performed by the same method as that of Example 2 except for that a mixed gas of nitrogen:oxygen=99.99:0.0100 (volume %) was used as the introduction gas and introduced at 75 L/min into a plasma treatment room. A carbon fiber bundle was obtained in the same way as Example 1 except them, and each measurement was performed. The measurement results are described in Table 1.

Example 4

Plasma treatment of the flameproof fiber bundle was performed by a similar method to that of Example 2 except that a mixed gas of nitrogen:oxygen=99.90:0.1000 (volume %) was used as the introduction gas into a plasma treatment room. A carbon fiber bundle was obtained similarly to Example 1 except them, and each measurement was performed. The measurement results are described in Table 1.

Example 5

A flameproof fiber bundle obtained in the same way as that of Example 1 was made into a sheet form of a fiber bundle having 4800 dtex/mm of the fineness per unit width. Each of the 2 sets of atmospheric pressure plasma devices is installed on each side of the flameproof fiber bundle, respectively, and the ejection port of the plasma gas was placed such that plasma gas was blowed onto the fiber bundle from the vertical direction to the sheet side of the fiber bundle. Using one of the plasma devices, nitrogen was introduced at 120 L/min, and oxygen was introduced at 0.012 L/min as the introduction gas, and the plasma gas was brought into contact with the fiber bundle for 0.5 seconds to perform plasma treatment at 1.0 mm of the distance d between the ejection port of the plasma gas of the atmospheric pressure plasma device and the fiber bundle, and 600 W of the power of the atmospheric pressure plasma device. Then, using the other plasma device, the plasma gas was brought into contact with the fiber bundle at the same treatment conditions from the vertical direction of the sheet side on the opposite side of the fiber bundle to perform the plasma treatment.

Using the flameproof fiber bundle that has undergone such plasma treatment, the absorbance was measured by the same method as that of Example 1. In addition, using the flameproof fiber bundle that has undergone the plasma treatment, a carbon fiber bundle was obtained by the same treatment as that of Example 1, and properties of a resin-impregnated strand were measured. The results of each measurement are described in Table 2.

Examples 6 to 9

The plasma treatment was performed in the same way as Example 5 except that the distance d between the ejection port of the plasma gas and the flameproof fiber bundle was changed as described in Table 2. Using the flameproof fiber bundle that has undergone such plasma treatment, the absorbance was measured same as Example 1. The measurement results are described in Table 2. In addition, the results of Comparative Example 1 were also described in Table 2 for comparison.

Examples 10 to 16

A flameproof fiber bundle obtained in the same way as that of Example 1 was made into a sheet form of the fiber bundle, and the plasma treatment was performed same as Example 5 except that the fineness per unit width of the flameproof fiber bundle when the fiber bundle passed the plasma treatment process was changed as described in Table 3. Using the flameproof fiber bundle that had undergone such plasma treatment, the absorbance was measured same as Example 1. In addition, with respect to Example 13, using the flameproof fiber bundle that had undergone the plasma treatment, a carbon fiber bundle was obtained by treatment same as that of Example 1, and properties of a resin-impregnated strand were measured. The results of each measurement are described in Table 3.

Examples 17 to 21

A flameproof fiber bundle obtained in the same way as that of Example 1 was made into a sheet form of the fiber bundle, and an atmospheric pressure plasma device was installed on only one side of the flameproof fiber bundle, and the plasma gas was brought into contact with the fiber bundle from only one side direction of the fiber bundle. Further, the fineness per unit width of the flameproof fiber bundle when the fiber bundle passed the plasma treatment process was as described in Table 3. The plasma treatment was performed by the same method as that of Example 10 except the above. Using the flameproof fiber bundle that has undergone such plasma treatment, the absorbance was measured by the same method as that of Example 1. In addition, with respect to Example 18, using the flameproof fiber bundle that had undergone the plasma treatment, a carbon fiber bundle was obtained by the same treatment as that of Example 1, and properties of a resin-impregnated strand were measured. The results of each measurement are described in Table 3.

Example 22

A flameproof fiber bundle obtained in the same way as that of Example 1 was made into a sheet form of the fiber bundle, and the plasma treatment was performed by the same treatment as that of Example 18 except that the plasma treatment time was 1 second. Using the flameproof fiber bundle that had undergone such plasma treatment, the absorbance was measured by the same method to that of Example 1. The measurement results are described in Table 3.

Examples 23 to 28

A flameproof fiber bundle obtained in the same way as that of Example 1 was made into a sheet form of the fiber bundle, and the plasma treatment was performed by the same treatment as that of Example 5 except that a mixed gas of nitrogen and oxygen was used as the introduction gas into a plasma treatment room, and the flow rate was changed as described in Table 4. Using the flameproof fiber bundle that had undergone such plasma treatment, the absorbance was measured by the same method as that of Example 1. The measurement results are described in Table 4.

In Examples 27 and 28, instable generation of plasma was observed. In addition, the results of Comparative Example 1 were described for comparison in Table 4.

Example 29

A flameproof fiber bundle obtained in the same way as that of Example 1 was made into a sheet form of the fiber bundle, and heated under tension at 700° C. of the maximum temperature in nitrogen atmosphere to give a pre-carbonized fiber bundle. Then, using the pre-carbonized fiber bundle, the plasma treatment was performed same as to Example 5. Using a pre-carbonized fiber bundle that had undergone such plasma treatment, the absorbance was measured by the same method as that of Example 1. The measurement results are described in Table 5.

Examples 30 to 33

The plasma treatment was performed by the same treatment as that of Example 29 except that the distance d between the ejection port of the plasma gas and the fiber bundle was changed to the conditions described in Table 6. Using a pre-carbonized fiber bundle that had undergone such plasma treatment, the absorbance was measured by the same method as that of Example 1. The measurement results are described in Table 5.

Comparative Example 2

Using a pre-carbonized fiber bundle obtained in a similar fashion to that of Example 29, the absorbance was measured by a similar method to that of Example 1 without performing the plasma treatment. The measurement results are described in Table 5.

Examples 34 to 40

A pre-carbonized fiber bundle was obtained in the same method as Example 29, and then with respect to this pre-carbonized fiber bundle, the plasma treatment was performed at the same conditions as those of Example 10 except that the fineness per unit width of the pre-carbonized fiber bundle when the fiber bundle passed the plasma treatment process was changed as described in Table 6. Using a pre-carbonized fiber bundle that had undergone such plasma treatment, the absorbance was measured by the same method as that of Example 1. The measurement results are described in Table 6. The results of Comparative Example 2 were described for comparison in Table 6. In addition, with respect to Example 37 and Comparative Example 2, the results of the dispersion test are described in Table 6.

Examples 41 to 45

A pre-carbonized fiber bundle was obtained in the same method as Example 29, and then with respect to this pre-carbonized fiber bundle, the pre-carbonized fiber bundle that had undergone the plasma treatment was obtained at the same conditions as those of Example 17 except that the fineness per unit width of the pre-carbonized fiber bundle when the fiber bundle passed the plasma treatment process was changed as described in Table 6. Using a pre-carbonized fiber bundle that had undergone such plasma treatment, the absorbance was measured by the same method as that of Example 1. The measurement results are described in Table 6. In addition, with respect to Example 42, the result of the dispersion test was described.

Example 46

A pre-carbonized fiber bundle was obtained in the same method as Example 29, and then with respect to this pre-carbonized fiber bundle, the pre-carbonized fiber bundle that had undergone the plasma treatment was obtained at the same conditions as those of Example 22 except that the plasma treatment time was 1 second. Using the pre-carbonized fiber bundle that had undergone such plasma treatment, the absorbance was measured by the same method as that of Example 1. The measurement results are described in Table 6.

Examples 47 to 52

Using a pre-carbonized fiber bundle obtained in the same method as Example 29, a pre-carbonized fiber bundle that had undergone the plasma treatment was obtained at the same conditions as those of Example 34 except that the flow rate of nitrogen and oxygen as the introduction gas into a plasma treatment room was changed as described in Table 7. Using the pre-carbonized fiber bundle that had undergone such plasma treatment, the absorbance was measured by the same method as that of Example 1. The measurement results are described in Table 7. In addition, the results of Comparative Example 2 were described for comparison (example in which the pre-carbonized fiber bundle had not undergone the plasma treatment) in Table 7.

Examples 53 to 56

Using a pre-carbonized fiber bundle obtained in the same method as Example 29, the same treatment as that of Example 46 was performed, to give a pre-carbonized fiber bundle that had undergone the plasma treatment except that the plasma treatment time was changed as described in Table 8. The surface of the fiber of the pre-carbonized fiber bundle that had undergone such plasma treatment was observed with a scanning electron microscope, and the number of the deposits having a size of 1 μm or more present per 100 $\mu m^2$ of the surface of the fiber was counted. The numbers are described in Table 8 as the "amount of a foreign substance".

Comparative Example 3

With respect to a pre-carbonized fiber bundle obtained in a similar method to Example 29, the "amount of a foreign substance" was measured by a similar method to that of Example 53 without performing plasma treatment. The measurement results are described in Table 8.

Examples 57 to 63

Using a sheet form of a flameproof fiber bundle having a fineness per unit width of 4800 dtex/mm obtained in the same way as that of Example 5, and excimer light (172 nm) irradiation unit for photochemical experiment (USHIO INC.), the flameproof fiber bundle was subjected to ultraviolet ray treatment at the distance of the flameproof fiber bundle and the ultraviolet ray lamp, and the time ultraviolet ray treatment as described in Table 9. Using the flameproof fiber bundle after the ultraviolet ray treatment, the absorbance was measured by the same method as that of Example 1. The measurement results are described in Table 9. In addition, with respect to the flameproofing fiber bundle that had undergone the ultraviolet ray treatment, and the pre-carbonized fiber bundle obtained by treatment in the same method as Example 29 using the flameproof fiber bundle that had undergone the ultraviolet ray treatment, the dispersion test was performed. Evaluation results are described in Table 9. In addition, the results of Comparative Example 1 are described in Table 9 for comparison.

Comparative Examples 4 to 6

These Comparative Examples show that when the deposits on the surface of the fiber bundle are removed using ozone gas only, the removal efficiency is poor.

A sheet form of a flameproof fiber bundle having a fineness per unit width of 4800 dtex/mm, which was obtained in the same way as that of Example 5, was used. The flameproof fiber bundle was passed into a treatment room filled with up 100 g/L concentration of ozone gas using an ozone generator (OZONAIZER-SG-01A, Sumitomo Precision Products Co., Ltd.). The time of the flameproof fiber bundle staying in the treatment room and being brought into contact with ozone gas was as described in Table 10. With respect to the flameproof fiber bundle that had undergone the ozone treatment, the absorbance measured in the same method as that of Example 1 is described in Table 10. In Comparative Examples 4 to 6, a long time was necessary to remove the deposits on the surface of the fiber to a degree similar to those of Examples 1 to 63.

TABLE 1

| | Conditions for Atmospheric Pressure Plasma Treatment | | | | Absorbance | | Strand Strength | |
|---|---|---|---|---|---|---|---|---|
| | Introduction Gas | Gas Flow rate (L/min) | Power (W) | Treatment Time (sec.) | (240 nm) (—) | (278 nm) (—) | Average (GPa) | σ (GPa) |
| Example 1 | Ar | 15 | 100 | 1.0 | 1.2 | 0.87 | 5.6 | 0.2 |
| Example 2 | $N_2$ | 75 | 375 | 0.50 | 1.3 | 0.82 | 5.6 | 0.2 |

TABLE 1-continued

| | Conditions for Atmospheric Pressure Plasma Treatment | | | | Absorbance | | Strand Strength | |
|---|---|---|---|---|---|---|---|---|
| | Introduction Gas | Gas Flow rate (L/min) | Power (W) | Treatment Time (sec.) | (240 nm) (—) | (278 nm) (—) | Average (GPa) | σ (GPa) |
| Example 3 | $N_2$:$O_2$ = 99.99:0.0100 | 75 | 375 | 0.50 | 0.87 | 0.65 | 5.7 | 0.2 |
| Example 4 | $N_2$:$O_2$ = 99.90:0.1000 | 75 | 375 | 0.50 | 0.95 | 0.72 | 5.6 | 0.1 |
| Comparative Example 1 | Untreated | — | — | — | 2.3 | 1.6 | 5.3 | 0.2 |

σ: Standard deviation

TABLE 2

| | Plasma Treatment Conditions | | | | Flameproof Fiber Bundle | | | | | | Strand Property | |
|---|---|---|---|---|---|---|---|---|---|---|---|---|
| | | $N_2$ | $O_2$ | Treatment | Filament | Number of | Total | Fineness per | Absorbance | | Strength | |
| | d mm | Flow rate L/min | Flow rate L/min | Conditions sec. | Fineness dtex | Filaments — | Fineness dtex | Unit Width dtex/mm | (240 nm) [—] | (278 nm) [—] | Average (GPa) | σ (GPa) |
| Example 5 | 1.0 | 120 | 0.012 | 0.50 sec ×2 (Both sides) | 0.8 | 12000 | 9600 | 4800 | 0.4 | 0.25 | 6.1 | 0.2 |
| Example 6 | 2.0 | ↑ | ↑ | ↑ | ↑ | ↑ | ↑ | ↑ | 1.1 | 0.79 | — | — |
| Example 7 | 3.0 | ↑ | ↑ | ↑ | ↑ | ↑ | ↑ | ↑ | 1.8 | 1.2 | — | — |
| Example 8 | 4.0 | ↑ | ↑ | ↑ | ↑ | ↑ | ↑ | ↑ | 2.2 | 1.5 | — | — |
| Example 9 | 5.0 | ↑ | ↑ | ↑ | ↑ | ↑ | ↑ | ↑ | 2.3 | 1.5 | — | — |
| Comparative Example 1 | | | Untreated | | ↑ | ↑ | ↑ | — | 2.3 | 1.6 | 5.3 | 0.2 |

d: Distance between ejection port of plasma gas and fiber bundle

σ: Standard deviation

TABLE 3

| | Plasma Treatment Conditions | | | | Flameproof Fiber Bundle | | | | | | Strand Property | |
|---|---|---|---|---|---|---|---|---|---|---|---|---|
| | | $N_2$ | $O_2$ | Treatment | Filament | Number of | Total | Fineness per | Absorbance | | Strength | |
| | d mm | Flow rate L/min | Flow rate L/min | Conditions sec. | Fineness dtex | Filaments — | Fineness dtex | Unit Width dtex/mm | (240 nm) [—] | (278 nm) [—] | Average (GPa) | σ (GPa) |
| Example 10 | 1.0 | 120 | 0.012 | 0.50 sec ×2 (Both sides) | 0.8 | 12000 | 9600 | 4800 | 1.00 | 0.72 | — | — |
| Example 11 | ↑ | ↑ | ↑ | ↑ | ↑ | ↑ | ↑ | 3200 | 0.92 | 0.59 | — | — |
| Example 12 | ↑ | ↑ | ↑ | ↑ | ↑ | ↑ | ↑ | 2400 | 0.58 | 0.40 | — | — |
| Example 13 | ↑ | ↑ | ↑ | ↑ | ↑ | ↑ | ↑ | 1920 | 0.40 | 0.25 | 6.1 | 0.2 |
| Example 14 | ↑ | ↑ | ↑ | ↑ | ↑ | ↑ | ↑ | 1200 | 0.44 | 0.31 | — | — |
| Example 15 | ↑ | ↑ | ↑ | ↑ | ↑ | ↑ | ↑ | 960 | 0.38 | 0.21 | — | — |
| Example 16 | ↑ | ↑ | ↑ | ↑ | ↑ | ↑ | ↑ | 640 | 0.42 | 0.23 | — | — |
| Example 17 | ↑ | ↑ | ↑ | 0.50 sec ×1 (One side) | ↑ | ↑ | ↑ | 4800 | 1.5 | 1.0 | — | — |
| Example 18 | ↑ | ↑ | ↑ | — | ↑ | ↑ | ↑ | 1920 | 1.1 | 0.71 | 5.9 | 0.2 |
| Example 19 | ↑ | ↑ | ↑ | — | ↑ | ↑ | ↑ | 1200 | 0.98 | 0.65 | — | — |
| Example 20 | ↑ | ↑ | ↑ | — | ↑ | ↑ | ↑ | 960 | 0.90 | 0.61 | — | — |
| Example 21 | ↑ | ↑ | ↑ | — | ↑ | ↑ | ↑ | 640 | 0.92 | 0.59 | — | — |
| Example 22 | ↑ | ↑ | ↑ | 1.0 sec ×1 (One side) | ↑ | ↑ | ↑ | 1920 | 0.84 | 0.56 | — | — |
| Comparative Example 1 | | | Untreated | | ↑ | ↑ | ↑ | — | 2.3 | 1.6 | 5.3 | 0.2 |

d: Distance between ejection port of plasma gas and fiber bundle

σ: Standard deviation

TABLE 4

| | Plasma Treatment Conditions | | | | Flameproof Fiber Bundle | | | | | |
|---|---|---|---|---|---|---|---|---|---|---|
| | d mm | $N_2$ Flow rate L/min | $O_2$ Flow rate L/min | Treatment Conditions sec. | Filament Fineness dtex | Number of Filaments — | Total Fineness dtex | Fineness per Unit Width dtex/mm | Absorbance (240 nm) [—] | Absorbance (278 nm) [—] |
| Example 23 | 1.0 | 120 | 0.001 | 0. 50 sec ×2 (Both | 0.8 | 12000 | 9600 | 4800 | 0.79 | 0.46 |
| Example 24 | ↑ | ↑ | 0.012 | ↑ | ↑ | ↑ | ↑ | ↑ | 0.40 | 0.25 |
| Example 25 | ↑ | ↑ | 0.120 | ↑ | ↑ | ↑ | ↑ | ↑ | 0.47 | 0.34 |
| Example 26 | ↑ | ↑ | 1.20 | ↑ | ↑ | ↑ | ↑ | ↑ | 1.2 | 0.79 |
| Example 27 | ↑ | ↑ | 3.60 | ↑ | ↑ | ↑ | ↑ | ↑ | 2.1 | 1.3 |
| Example 28 | ↑ | ↑ | 6.00 | ↑ | ↑ | ↑ | ↑ | ↑ | 2.3 | 1.5 |
| Comparative Example 1 | | | Untreated | | ↑ | ↑ | ↑ | — | 2.3 | 1.6 |

d: Distance between ejection port of plasma gas and fiber bundle

TABLE 5

| | Plasma Treatment Conditions | | | | Pre-carbonization Fiber Bundle | | | | | |
|---|---|---|---|---|---|---|---|---|---|---|
| | d mm | $N_2$ Flow rate L/min | $O_2$ Flow rate L/min | Treatment Conditions sec. | Filament Fineness dtex | Number of Filaments — | Total Fineness dtex | Fineness per Unit Width dtex/mm | Absorbance (240 nm) (—) | Absorbance (278 nm) (—) |
| Example 29 | 1.0 | 120 | 0.012 | 0.50 sec ×2 (Both sides) | 0.8 | 12000 | 9600 | 4800 | 0.13 | 0.08 |
| Example 30 | 2.0 | ↑ | ↑ | ↑ | ↑ | ↑ | ↑ | ↑ | 0.18 | 0.12 |
| Example 31 | 3.0 | ↑ | ↑ | ↑ | ↑ | ↑ | ↑ | ↑ | 0.22 | 0.13 |
| Example 32 | 4.0 | ↑ | ↑ | ↑ | ↑ | ↑ | ↑ | ↑ | 0.23 | 0.14 |
| Example 33 | 5.0 | ↑ | ↑ | ↑ | ↑ | ↑ | ↑ | ↑ | 0.25 | 0.15 |
| Comparative Example 2 | | | Untreated | | ↑ | ↑ | ↑ | — | 0.30 | 0.17 |

d: Distance between ejection port of plasma gas and fiber bundle

TABLE 6

| | Plasma Treatment Conditions | | | | Pre-carbonization Fiber Bundle | | | | | | |
|---|---|---|---|---|---|---|---|---|---|---|---|
| | d mm | $N_2$ Flow rate L/min | $O_2$ Flow rate L/min | Treatment Conditions sec. | Filament Fineness dtex | Number of Filaments — | Total Fineness dtex | Fineness per Unit Width dtex/mm | Absorbance (240 nm) (—) | Absorbance (278 nm) (—) | Dispersion Test Piece/ 12K |
| Example 34 | 1.0 | 120 | 0.012 | 0.50 sec ×2 (Both sides) | 0.8 | 12000 | 9600 | 4800 | 0.24 | 0.16 | — |
| Example 35 | ↑ | ↑ | ↑ | ↑ | ↑ | ↑ | ↑ | 3200 | 0.22 | 0.15 | — |
| Example 36 | ↑ | ↑ | ↑ | ↑ | ↑ | ↑ | ↑ | 2400 | 0.18 | 0.11 | — |
| Example 37 | ↑ | ↑ | ↑ | ↑ | ↑ | ↑ | ↑ | 1920 | 0.16 | 0.1 | 403 |
| Example 38 | ↑ | ↑ | ↑ | ↑ | ↑ | ↑ | ↑ | 1200 | 0.12 | 0.09 | — |
| Example 39 | ↑ | ↑ | ↑ | ↑ | ↑ | ↑ | ↑ | 960 | 0.16 | 0.11 | — |
| Example 40 | ↑ | ↑ | ↑ | ↑ | ↑ | ↑ | ↑ | 640 | 0.11 | 0.09 | — |
| Example 41 | ↑ | ↑ | ↑ | 0.50 sec ×1 (One side) | ↑ | ↑ | ↑ | 4800 | 0.28 | 0.18 | — |
| Example 42 | ↑ | ↑ | ↑ | ↑ | ↑ | ↑ | ↑ | 1920 | 0.21 | 0.14 | 446 |
| Example 43 | ↑ | ↑ | ↑ | ↑ | ↑ | ↑ | ↑ | 1200 | 0.2 | 0.14 | — |
| Example 44 | ↑ | ↑ | ↑ | ↑ | ↑ | ↑ | ↑ | 960 | 0.19 | 0.12 | — |
| Example 45 | ↑ | ↑ | ↑ | ↑ | ↑ | ↑ | ↑ | 640 | 0.17 | 0.11 | — |
| Example 46 | ↑ | ↑ | ↑ | 1.0 sec ×1 (One side) | ↑ | ↑ | ↑ | 1920 | 0.19 | 0.14 | — |
| Comparative Example 2 | — | — | — | — | ↑ | ↑ | ↑ | — | 0.30 | 0.17 | 615 |

d: Distance between ejection port of plasma gas and fiber bundle

TABLE 7

| | Plasma Treatment Conditions | | | | Pre-carbonization Fiber Bundle | | | | Absorbance | |
|---|---|---|---|---|---|---|---|---|---|---|
| | d mm | $N_2$ Flow rate L/min | $O_2$ Flow rate L/min | Treatment Conditions sec. | Filament Fineness dtex | Number of Filaments — | Total Fineness dtex | Fineness per Unit Width dtex/mm | (240 nm) [—] | (278 nm) [—] |
| Example 47 | 1.0 | 120 | 0.001 | 0.50 sec ×2 (Both sides) | 0.8 | 12000 | 9600 | 4800 | 0.15 | 0.11 |
| Example 48 | ↑ | ↑ | 0.012 | ↑ | ↑ | ↑ | ↑ | ↑ | 0.11 | 0.09 |
| Example 49 | ↑ | ↑ | 0.12 | ↑ | ↑ | ↑ | ↑ | ↑ | 0.14 | 0.11 |
| Example 50 | ↑ | ↑ | 1.2 | ↑ | ↑ | ↑ | ↑ | ↑ | 0.18 | 0.13 |
| Example 51 | ↑ | ↑ | 3.6 | ↑ | ↑ | ↑ | ↑ | ↑ | 0.25 | 0.18 |
| Example 52 | ↑ | ↑ | 6.0 | ↑ | ↑ | ↑ | ↑ | ↑ | 0.27 | 0.17 |
| Comparative Example 2 | — | — | — | — | ↑ | ↑ | ↑ | — | 0.30 | 0.17 |

d: Distance between ejection port of plasma gas and fiber bundle

TABLE 8

| | Plasma Treatment Conditions | | | | SEM |
|---|---|---|---|---|---|
| | d mm | $N_2$ Flow rate L/min | $O_2$ Flow rate L/min | Treatment Time sec. | Amount of Foreign Substance Pieces/100 $\mu m^2$ |
| Example 53 | 1.0 | 120 | 0.012 | 1.0 | 4 |
| Example 54 | ↑ | ↑ | ↑ | 5.0 | 1 |
| Example 55 | ↑ | ↑ | ↑ | 30 | 0 |
| Example 56 | ↑ | ↑ | ↑ | 60 | 0 |
| Comparative Example 3 | | | Untreated | | 9 |

d: Distance between ejection port of plasma gas and fiber bundle

TABLE 9

| | Ultraviolet Ray Treatment Conditions | | | Dispersion Test | | Absorbance | |
|---|---|---|---|---|---|---|---|
| | Treatment Time sec. | Distance between Fiber Bundle and Ultraviolet Ray Lamp mm | Luminous Energy of Ultraviolet Ray $mW/cm^2$ | Flameproof Fiber Bundle Pieces/12K | Pre-carbonization Fiber Bundle Pieces/12K | (240 nm) (—) | (278 nm) (—) |
| Example 57 | 5 | 1.0 | 7.8 | 1052 | 505 | 2.3 | 1.6 |
| Example 58 | 10 | 1.0 | 7.9 | 1008 | 523 | 2.1 | 1.4 |
| Example 59 | 20 | 1.0 | 7.9 | 833 | 452 | 2.1 | 1.3 |
| Example 60 | 30 | 1.0 | 7.8 | 715 | 403 | 1.6 | 1.2 |
| Example 61 | 30 | 2.0 | 6.5 | 720 | 395 | 1.7 | 1.2 |
| Example 62 | 30 | 3.0 | 4.7 | 902 | 444 | 2.0 | 1.3 |
| Example 63 | 30 | 5.0 | 1.8 | 1095 | 634 | 2.3 | 1.6 |
| Comparative Example 1 | | Untreated | | 1110 | 568 | 2.3 | 1.6 |

TABLE 10

| | Ozone Gas Treatment Conditions | | Absorbance | |
|---|---|---|---|---|
| | Treatment Time sec. | Gas Concentration g/L | (240 nm) (—) | (278 nm) (—) |
| Comparative Example 4 | 60 | 100 | 1.7 | 1.1 |
| Comparative Example 5 | 300 | 100 | 1.4 | 0.86 |
| Comparative Example 6 | 600 | 100 | 0.78 | 0.53 |

TABLE 10-continued

| | Ozone Gas Treatment Conditions | | Absorbance | |
|---|---|---|---|---|
| | Treatment Time sec. | Gas Concentration g/L | (240 nm) (—) | (278 nm) (—) |
| Comparative Example 1 | Untreated | | 2.3 | 1.6 |

INDUSTRIAL APPLICABILITY

The carbon fiber bundle of the present invention can be used in various fields including a material for aviation or space such as an airplane and a rocket, a material for sporting goods such as a tennis racket, a golf shaft and a fishing rod, a material for transportation such as a ship and a motorcar, a material for a part of electronic devices such as a mobile telephone and a cabinet of a personal computer, and a material for an electrode of a fuel cell.

The invention claimed is:

1. A method for producing a carbon fiber bundle, the method comprising:

performing a plasma treatment of bringing a fiber bundle A, which is a carbon fiber precursor acrylic fiber bundle having undergone flameproofing treatment by heating, into contact with a plasma gas in gas phase; and performing carbonization treatment of a fiber bundle B, which has been obtained by the plasma treatment, wherein the plasma gas is generated by introducing a mixed gas of inactive gas in a range of 97.00 volume % to 99.99 volume % and active gas in a range of 0.0100 volume % to 3.000 volume % into a plasma generation device.

2. The method for producing a carbon fiber bundle according to claim 1, wherein the density of the fiber bundle A to be subjected to the plasma treatment is in a range of 1.30 g/cm$^3$ to 1.50 g/cm$^3$.

3. The method for producing a carbon fiber bundle according to claim 1, wherein the density of the fiber bundle A to be subjected to the plasma treatment is in a range of 1.50 g/cm$^3$ to 1.70 g/cm$^3$.

4. The method for producing a carbon fiber bundle according to claim 1, wherein the plasma gas is ejected from an ejection port and brought into contact with the fiber bundle A such that the distance d between the ejection port of the plasma gas of a plasma generation device and the fiber bundle A is in a range of 0.5 mm to 10 mm.

5. The method for producing a carbon fiber bundle according to claim 2, wherein the fiber bundle A is made into a sheet form having a fineness per unit width in a range of 500 dtex/mm to 5000 dtex/mm, and the fiber bundle in the sheet form is brought into contact with the plasma gas.

6. The method for producing a carbon fiber bundle according to claim 3, wherein the fiber bundle A is made into a sheet form having a fineness per unit width in a range of 500 dtex/mm to 5000 dtex/mm, and the fiber bundle in the sheet form is brought into contact with the plasma gas.

7. The method for producing a carbon fiber bundle according to claim 1, wherein the plasma gas is ejected from each direction facing to each side of the fiber bundle in the sheet form.

8. The method for producing a carbon fiber bundle according to claim 2, wherein the absorbance, which is measured by the measuring method below, of the fiber bundle B to be subjected to the carbonization treatment satisfies condition 1 and/or condition 2 as follows:

condition 1: absorbance at 240 nm of the wavelength is 1.5 or less;

condition 2: absorbance at 278 nm of the wavelength is 1.0 or less.

9. The method for producing a carbon fiber bundle according to claim 3, wherein the absorbance, which is measured by the measuring method below, of the fiber bundle B to be subjected to the carbonization treatment satisfies condition 1 and/or condition 2 as follows:

condition 1: absorbance at 240 nm of the wavelength is 0.20 or less;

condition 2: absorbance at 278 nm of the wavelength is 0.15 or less.

10. The method for producing a carbon fiber according to claim 2, wherein the total number of cavities and particles having a size of 1 μm or more which are present on the surface of filaments that are present on the surface of the fiber bundle B to be subjected to the carbonization treatment is 5 or less per 100 μm$^2$ area of the surface of the filaments.

11. The method for producing a carbon fiber according to claim 3, wherein the total number of cavities and particles having a size of 1 μm or more which are present on the surface of filaments that are present on the surface of the fiber bundle B to be subjected to the carbonization treatment is 5 or less per 100 μm$^2$ area of the surface of the filaments.

12. The method for producing a carbon fiber according to claim 5, wherein the total number of cavities and particles having a size of 1 μm or more which are present on the surface of filaments that are present on the surface of the fiber bundle B to be subjected to the carbonization treatment is 5 or less per 100 μm$^2$ area of the surface of the filaments.

13. The method for producing a carbon fiber according to claim 6, wherein the total number of cavities and particles having a size of 1 μm or more which are present on the surface of filaments that are present on the surface of the fiber bundle B to be subjected to the carbonization treatment is 5 or less per 100 μm$^2$ area of the surface of the filaments.

14. A method for producing a carbon fiber bundle, the method comprising:

heating a fiber bundle of a carbon fiber precursor to perform a flame proofing treatment;

rendering the density of the fiber bundle in a range of 1.30 g/cm$^3$ to 1.50 g/cm$^3$ by the flameproofing treatment to obtain a fiber bundle C; and subjecting the fiber bundle C to carbonization treatment;

wherein the absorbance, which is measured by the measuring method below, of the fiber bundle C to be subjected to carbonization treatment satisfies condition 1 and/or condition 2 as follows:

condition 1: absorbance at 240 nm of the wavelength is 1.5 or less;

condition 2: absorbance at 278 nm of the wavelength is 1.0 or less, and the fiber bundle C to be subjected to the carbonization treatment is a fiber bundle that is obtained by performing ultraviolet ray treatment comprising irradiating the fiber bundle with an ultraviolet ray in a gas phase, after the flameproofing treatment.

15. A method for producing a carbon fiber bundle, the method comprising:

heating a fiber bundle of a carbon fiber precursor to perform a flame proofing treatment;

rendering the density of the fiber bundle in a range of 1.50 g/cm$^3$ to 1.70 g/cm$^3$ after the flameproofing treatment to obtain a fiber bundle C; and subjecting the fiber bundle C to carbonization treatment;

wherein:

the total number of cavities and particles having a size of 1 μm or more which are present on the surface of filaments that are present on the surface of the fiber bundle C to be subjected to the carbonization treatment is 5 or less per 100 μm$^2$ area of the surface of the filaments;

the fiber bundle C to be subjected to the carbonization treatment is a fiber bundle that is obtained by performing plasma treatment comprising contacting the fiber bundle with a plasma gas in a gas phase, after the flameproofing treatment; and the plasma gas is generated by introducing a mixed gas of inactive gas in a range of 97.00 volume % to 99.99 volume % and active gas in a range of 0.0100 volume % to 3.000 volume % into a plasma generation device.

16. The method for producing a carbon fiber bundle according to claim 14, wherein luminous energy per unit area of the ultraviolet ray irradiated in the ultraviolet ray treatment is in a range of 3 mW/cm$^2$ to 10 mW/cm$^2$.

* * * * *